US005868586A

United States Patent [19]

Maejima

[11] Patent Number: 5,868,586

[45] Date of Patent: Feb. 9, 1999

[54] FIXING CLIP OF RESIN MOLDED PART

[75] Inventor: Toshiro Maejima, Haibara-gun, Japan

[73] Assignee: Yazaki Corporation, Tokyo, Japan

[21] Appl. No.: 798,160

[22] Filed: Feb. 10, 1997

[30] Foreign Application Priority Data

Feb. 16, 1996 [JP] Japan ..... 8-029696

[51] Int. Cl.[6] ..... H01R 13/60

[52] U.S. Cl. ..... 439/567; 439/557

[58] Field of Search ..... 439/567, 557, 439/552, 570; 52/208

[56] References Cited

FOREIGN PATENT DOCUMENTS 3-118303 12/1991 Japan .

*Primary Examiner*—Neil Abrams
*Assistant Examiner*—Antoine Ngandjui
*Attorney, Agent, or Firm*—Morgan, Lewis & Bockius LLP

[57] ABSTRACT

A clip fixes a connector housing having a bore for preventing generation of a shrinkage mark in the vicinity of an outer peripheral wall onto a panel. The clip comprises a clip body including: an engagement portion for engagement with the panel; and an attachment portion having a felled-U shape in side view, the attachment portion being constituted by a first holding member which is able to be inserted into the bore of the connector housing and a second holding member which is designed to sandwich the outer peripheral wall of the connector housing between the first and second holding members when the first holding member is fitted into the bore.

8 Claims, 3 Drawing Sheets

FIXING CLIP OF RESIN MOLDED PART

BACKGROUND OF THE INVENTION

1. Field of the Invention

The present invention relates to a fixing clip for fixing a resin molded part such as a connector housing or the like to an objective member such as a car body panel or the like.

2. Description of the Prior Art

As the method of fixing a member, for example, a connector which is a wiring part of a car, to a panel (an attachment objective member) by using a clip, there have been a method in which a clip is formed directly on the connector and another method in which a clip is formed separately from the connector and then attached on the connector. FIG. 5 shows the former method. In this method, a connector 1 has female and male connector housings 2 and 3 which are fitted to each other, and a clip 4 which is integrally formed on an outer peripheral wall of the female connector housing 2. The female connector housing 2 is positioned outside when the female and male connector housings 2 and 3 are fitted to each other.

As the latter method, on the other hand, there have been proposals of a method in which a hand clip is wound on an outer periphery of a connector, a method in which a clip attachment portion is formed on a connector housing in advance, a clip is attached on the attachment portion, and then the connector is fixed to a panel, etc.

Thus, the clip is integrally formed in the former method and the clip attachment portion is formed in advance in the latter method. In either case, therefore, there has been such a problem that it is necessary to provide the connector housings as exclusive parts which have therefore no general-purpose property so that the molding cost becomes increased.

SUMMARY OF THE INVENTION

The present invention has been accomplished in view of the foregoing, and an object of the present invention is to provide a clip which is high in general-purpose property such that the clip can be attached by utilizing a feature in shape which is peculiar to a resin molded part such as a connector or the like, and in which it is not necessary to give particular working on a connector housing (resin molded part).

According to the present invention, there is provided a fixing clip for fixing a resin molded part having a bore for preventing generation of a shrinkage mark in a vicinity of an outer peripheral wall thereof onto an attachment objective member, comprising: a clip body having an engagement portion for engagement with the attachment objective member; and an attachment portion being U-shaped in side view, the attachment portion including: a first holding member which is able to be inserted into the bore of the resin molded part; and a second holding member which is designed to sandwich the outer peripheral wall of the resin molded part between the first and second holding members when the first holding member is fitted into the bore.

A case of fixing a connector housing as a resin molded part will be described by way of example. Since it is necessary to form mold terminal receiving chambers or the like in a connector housing with high accuracy, a bore for preventing generation of a shrinkage mark in molding is often provided in the vicinity of an outer peripheral wall of the connector housing. Then, the bore is utilized, according to the present invention, in such a manner that the first holding member is fitted into the bore and the second holding member is positioned outside the outer peripheral wall. As a result, the first and second holding members sandwich the outer peripheral wall therebetween so that the clip and the connector housing are coupled with each other. The engagement portion of the clip is engaged with the attachment objective member so that the connector housing can be fixed to the attachment objective member through the clip.

In this case, if a lock portion is provided on the inner surface of the second holding member, the lock portion can be engaged with a knob projection which is projected from the outer peripheral wall of the connector housing for releasing the fitting of the connector housing, and therefore the connector housing can be prevented from coming off. Further, if the distance between the first and second holding members is gradually reduced from a base end of the U-shaped attachment portion toward a front end of the same, the clip and the connector housing can be connected to each other without generating any chattering.

BRIEF DESCRIPTION OF THE DRAWINGS

In the accompanying drawings:

FIGS. 1A and 1B are views showing an embodiment of the clip according to the present invention, in which FIG. 1A is a perspective view showing a clip as well as a panel which is an attachment objective member, and FIG. 1B is a side view showing the clip when viewed from an arrow B;

DETAILED DESCRIPTION OF THE PREFERRED EMBODIMENT

A preferred embodiment of the fixing clip of a resin molded part according to the present invention will be described under with reference to the accompanied drawings.

Figure 1A:
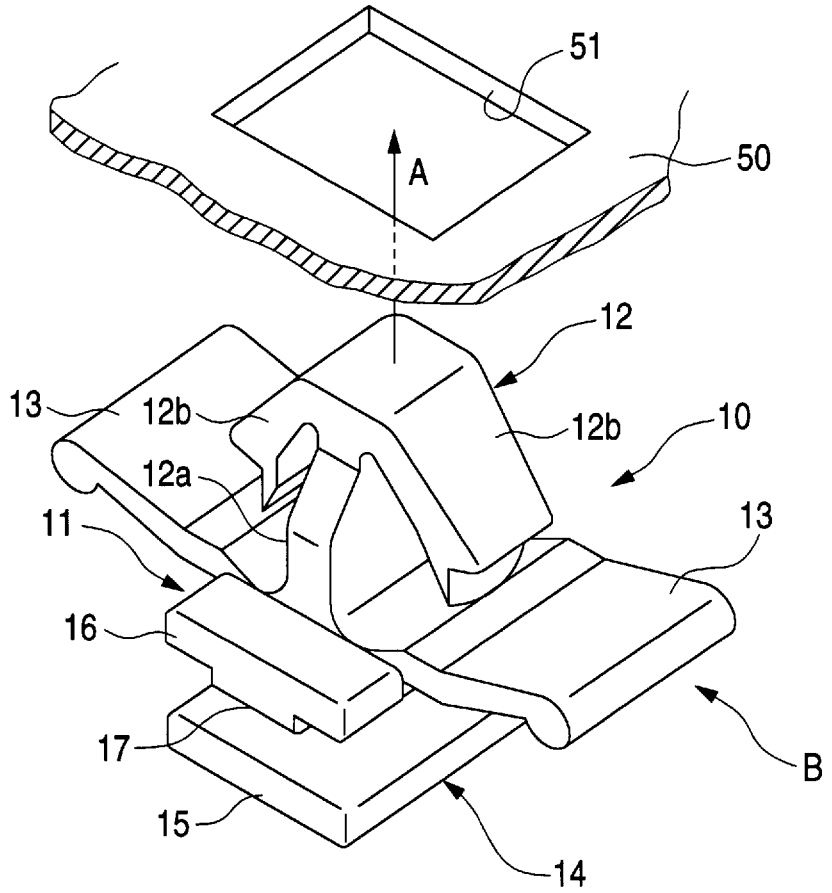
Figure 1B:
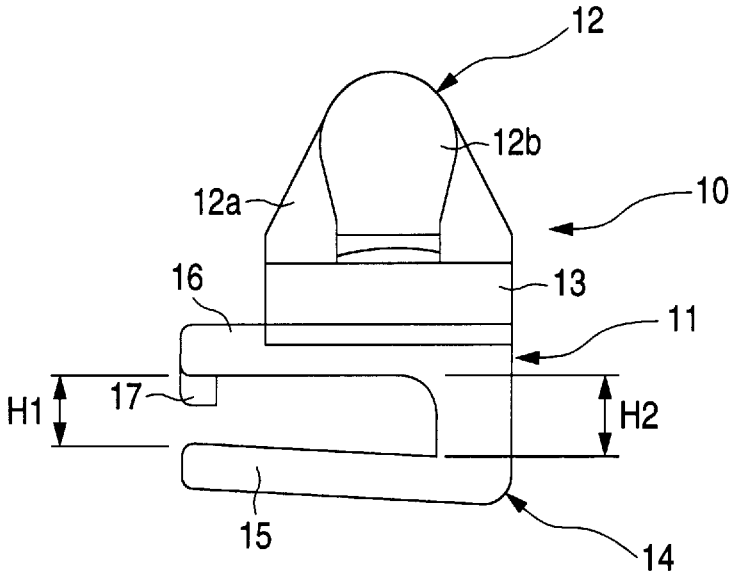
Figure 2:
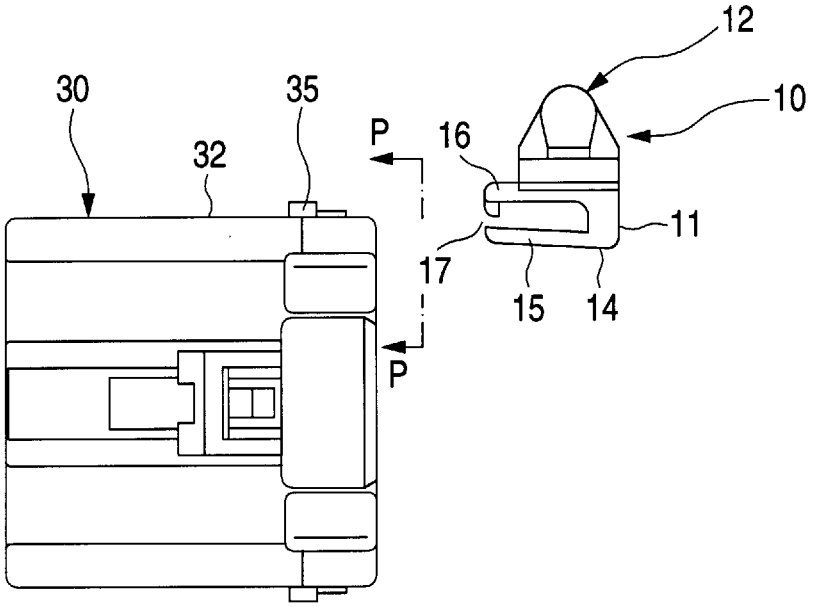
FIG. 2 is a side view showing the clip and the female connector housing to which the clip is attached.

FIGS. 1A and 1B are views showing an embodiment of the clip according to the present invention, FIG. 1A being a perspective view showing the clip and a panel to which the clip is attached, FIG. 1B being a side view showing the clip when viewed from an arrow B. Further, FIG. 2 is a side view showing the clip and a female connector housing to which the clip is attached.

The clip 10 is constituted as a whole by integrally-molded resin parts. A clip body 11 of the clip 10 is provided with an engagement portion 12 which engages with a fitting hole 51 of a panel 50 to which the clip 10 is attached, and the clip body 11 is further provided with an attachment portion 14 to be attached to a female connector housing 30 (FIG. 2). The engagement portion 12 to be engaged with the panel 50 is constituted by: a main pole portion 12*a* projected from the clip body 11; arrowhead elastic engagement members 12*b* and 12*b* formed on a front end of the main pole portion 12*a* so as to be engaged with an opening edge of the fitting hole 51 of the panel 50; and elastic pressing members 13 and 13 which are urged against a surface of the panel 50 so as to stabilize the state of engagement.

The attachment portion 14 to be attached to the connector housing 30 is provided in opposition to the engagement portion 12 and formed into a U-shape in side view so as to have a pair of holding members 15 and 16. The two holding members 15 and 16 are faced to each other with a distance in the fitting direction (in the direction of an arrow A) of the engagement portion 12 in such a manner that the first holding member 15 is located in the position faraway from the engagement portion 12 and the second holding member 16 is located at the position near the same. Further, the engagement portion 12 is integrally formed on the upper surface of the second holding member 16.

Figure 3:
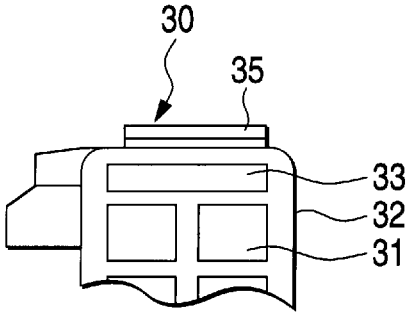
FIG. 3 is a cross section when viewed in the direction of the arrows P—P in FIG. 2.

In the connector housing 30, on the other hand, terminal receiving chambers 31 are formed forward from the rear end surface of the connector housing 30 as shown in FIG. 3. A bore 33 having a substantially rectangular shape in cross section is formed in a thick portion between the endmost terminal receiving chamber 31 and the outer surface of the outer peripheral wall 32 to make the resin thickness uniform so as to achieve the molding accuracy. The bore 33 extends forward in parallel to the outer peripheral wall 32. Further, a knob projection 35 for releasing connector fitting is projected on a rear end portion of the outer surface of the outer peripheral wall 32 adjacent to the bore 33.

Moreover, the first holding member 15 of the clip 10 is formed into a belt-like plate having a constant width so as to be fitted from its front end into the bore 33 of the connector housing 30 and also the second holding member 16 is formed into a shape corresponding to the first holding member 15 so as to sandwich the outer peripheral wall 32 of the connector housing 30 together with the first holding member 15. In this case, the distance between the first and second holding members 15 and 16 is made to be gradually reduced from the base end of the attachment portion 14 to the front end of the same. That is, when the distances between the first and second holding members 15 and 16 at the base and front ends are represented by H1 and H2 respectively, the condition of $H1<H2$ is established. Further, a lock portion 17 is projected on the inner surface of the second holding member 16 so as to engage with the knob projection 35 of the connector housing 30.

When the connector housing 30 is fixed on the panel 50 by using the foregoing clip 10, first, the clip 10 is disposed on the rear end of the connector housing 30 so that the first holding member 15 is fitted into the bore 33 opened in the rear end surface of the connector housing 30 and the second holding member 16 is positioned outside the outer peripheral wall 32 as shown in FIG. 2 The holding members 15 and 16 sandwich the outer peripheral wall 32 to thereby connect the clip 10 and the connector housing 30 to each other. At this time, the distance between the front ends of the first and second holding members 15 and 16 is set to be narrow, and the clip 10 is therefore connected to the connector housing 30 without having any chattering. Further, the lock portion 17 of the second holding member 16 is engaged with the knob projection 35 so that the holding members 15 and 16 are prevented from coming off.

Figure 4:
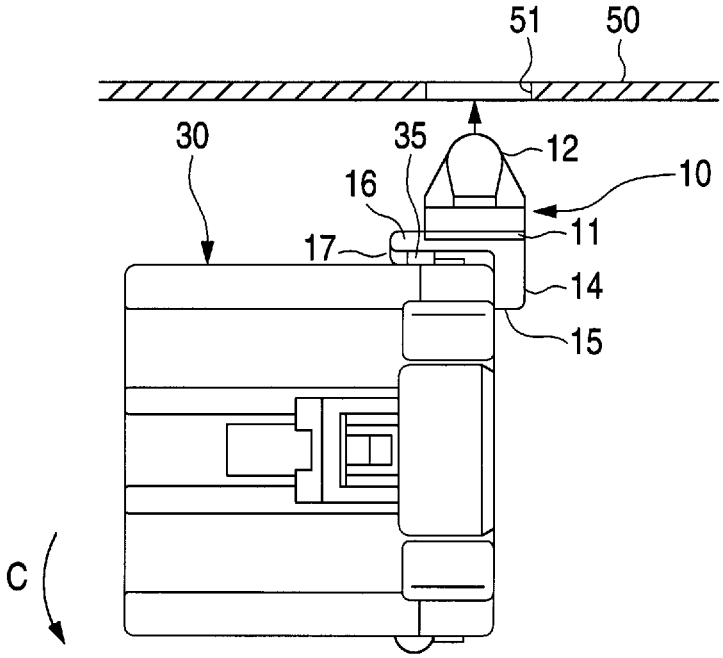
FIG. 4 is a side view showing the state where the clip attached on the connector housing is to be attached on the panel.
Figure 5:
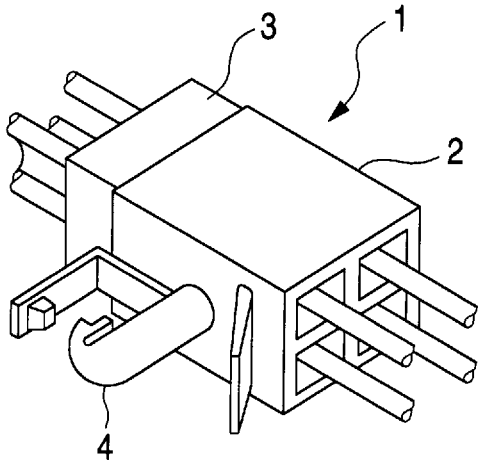
FIG. 5 PRIOR ART
FIG. 5 is a perspective view showing the conventional example of a connector housing having a clip.

FIG. 4 shows a connected state. If the engagement portion 12 of the clip 10 is engaged with the fitting hole 51 of the panel 50 in this state, the connector housing 30 can be fixed on the panel 50 through the clip 10. When the connector housing 30 is removed from the clip 10, on the contrary, the front side of the connector housing 30 is twisted in the direction of an arrow C while being pulled down. Then, the U-shaped attachment portion 14 of the clip 10 is bent and the lock portion 17 of the second holding member 16 is separated from the knob projection 35 of the connector housing 30. Therefore, when the connector housing 30 is slid forward in this state, the first holding member 15 is separated from the bore 33 (FIG. 3) and the connection between the clip 10 and the connector housing 30 can be released. Further, the removal of the clip 10 from the panel 50 can be performed by pulling the arrowhead elastic engagement portions 12*a* and 12*b* out of the fitting hole 51 of the panel 50 in the state where the portions 12*a* and 12*b* are elastically transformed so as to narrow the distance therebetween.

Since the clip 10 can be attached by utilizing the bore 33 formed in the connector housing 30, it is not necessary to give particular working on the connector housing 30.

Although the case of a connector housing as the resin molded part has been described in the foregoing embodiment, the present invention can be widely applied to any resin molded part other than such a connector housing so long as the resin molded part has a bore into which the first holding member can be inserted.

As described above, according to the present invention, by insertion of the first holding member into the bore of the resin molded part such as a connector housing, it is possible to make the first and second holding members sandwich the outer peripheral wall of the resin molded part to thereby couple the clip with the resin molded part. Therefore, if the engagement portion of the clip is engaged with the objective member to which the clip is attached in this state, the resin molded part can be fixed to the objective member by means of the clip. Since the clip can be coupled with the resin molded part and only by inserting the first holding member into the bore for preventing generation of a shrinkage mark, it is not necessary to give particular working on the resin molded part. Consequently, not only the cost is reduced, but also the general-purpose property of each of the resin molded part and the clip can be increased.

Further, in the case where the resin molded part is a connector housing, if a lock portion is provided on the inner surface of the second holding member, the lock portion can be engaged with the knob projection projected from the outer peripheral wall of the connector housing for releasing the connector fitting so that the connector housing can be prevented from coming off. Moreover, if the distance between the first and second holding members is gradually reduced from a base end of the U-shaped attachment portion toward a front end of the same, the attachment strength can be further increased so that it is possible to prevent chattering from occuring.

What is claimed is:

1. A fixing clip for fixing a resin molded part having a bore for preventing generation of a shrinkage mark in a vicinity of an outer peripheral wall thereof onto an attachment objective member, comprising:

a clip body having an engagement portion for engagement with the attachment objective member; and an attachment portion being U-shaped in side view, the attachment portion including: a first holding member which is able to be inserted into the bore of the resin molded part; and a second holding member which is designed to sandwich the outer peripheral wall of the resin molded part between the first and second holding members when the first holding member is fitted into the bore.

2. The fixing clip according to claim 1, wherein the resin molded part is a connector housing.

3. The fixing clip according to claim 2, further comprising a lock portion formd on an inner surface of the second holding member so that the lock portion engages with a knob projection which is provided on an outer peripheral wall of the connector housing so as to project therefrom for releasing connector fitting.

4. The fixing clip according to claim 1, wherein a distance between the first and second holding members is set to be gradually reduced from a base end of the attachment portion toward a front end thereof.

5. The fixing clip according to claim 2, wherein a distance between the first and second holding members is set to be gradually reduced from a base end of the attachment portion toward a front end thereof.

6. The fixing clip according to claim 3, wherein a distance between the first and second holding members is set to be gradually reduced from a base end of the attachment portion toward a front end thereof.

7. The fixing clip according to claim 1, wherein the engagement portion comprises: a main pole portion projected from the clip body; and arrowhead elastic engagement members formed on a front end of the main pole portion.

8. The fixing clip according to claim 1, further comprising an elastic pressing member which is urged against a surface of the attachment objective member so as to stabilize state of engagement.

* * * * *